US006598263B2

(12) United States Patent
Boles et al.

(10) Patent No.: US 6,598,263 B2
(45) Date of Patent: Jul. 29, 2003

(54) VACUUM CLEANER DIRT COLLECTING SYSTEM WITH FILTER CLEANING DEVICES

(75) Inventors: David J. Boles, Barberton, OH (US); Nick M. Bosyj, North Canton, OH (US); David A. Bradshaw, Canton, OH (US); Charles R. Morrow, Alliance, OH (US); Rodney J. Svik, North Canton, OH (US); Kevin S. Waltz, Massillon, OH (US)

(73) Assignee: The Hoover Company, North Canton, OH (US)

( * ) Notice: Subject to any disclaimer, the term of this patent is extended or adjusted under 35 U.S.C. 154(b) by 40 days.

(21) Appl. No.: 09/852,178

(22) Filed: May 9, 2001

(65) Prior Publication Data

US 2002/0166199 A1 Nov. 14, 2002

(51) Int. Cl.[7] ..... A47L 9/20

(52) U.S. Cl. ..... 15/352; 15/347; 55/300; 55/305; 55/DIG. 3

(58) Field of Search ..... 15/352, 347; 55/300, 55/305, DIG. 3

(56) References Cited

U.S. PATENT DOCUMENTS

| | | | | |
|---|---|---|---|---|
| 1,038,167 A | | 9/1912 | Maitland | |
| 1,134,294 A | | 4/1915 | Supanz | |
| 2,594,456 A | * | 4/1952 | Kroenlein | 55/296 |
| 3,259,268 A | | 7/1966 | Anderson | |
| 3,320,727 A | | 5/1967 | Farley | |
| 3,591,888 A | | 7/1971 | Takeda | |
| 3,708,962 A | * | 1/1973 | Deguchi et al. | 55/300 |
| 3,731,465 A | * | 5/1973 | Ohira et al. | 55/299 |
| 3,797,064 A | | 3/1974 | MacFarland | |
| 3,841,067 A | | 10/1974 | Kato et al. | |
| 3,856,488 A | * | 12/1974 | Kato et al. | 55/300 |
| 4,878,930 A | | 11/1989 | Minniso et al. | |
| 5,135,552 A | | 8/1992 | Weistra | |
| 5,143,529 A | | 9/1992 | Means, Jr. | |
| 5,704,956 A | | 1/1998 | Loveless et al. | |
| 5,855,634 A | | 1/1999 | Berfield | |
| 6,192,550 B1 | | 2/2001 | Hamada et al. | |

OTHER PUBLICATIONS

Photographs of Kenmore Model 3713200 Upright Bagless Cleaner Purchased Nov. 3, 2000.

* cited by examiner

*Primary Examiner*—Theresa T. Snider
(74) *Attorney, Agent, or Firm*—A. Burgess Lowe; Michael J. Corrigan

(57) ABSTRACT

A dirt collecting system for a vacuum cleaner includes a dirt cup formed with a coarse particle separation chamber and a fine particle separation chamber separated by an apertured wall. Coarse dirt particles directed into the coarse particle separation chamber are prevented from entering the fine particle separation chamber by the apertured wall. The apertured wall is removable from the dirt cup and is cleaned upon removal by a cleaning element. A fine particle filter is located in the fine particle separation chamber for filtering fine particles. The fine particle filter is cleaned by rotating a knob located in the dirt cup lid so that the pleats of the fine particle filter is brushed past a wiper element.

15 Claims, 7 Drawing Sheets

VACUUM CLEANER DIRT COLLECTING SYSTEM WITH FILTER CLEANING DEVICES

FIELD OF THE INVENTION

Generally, the invention relates to vacuum cleaners. Particularly, the invention relates to a dirt collection system for a vacuum cleaner having filter cleaning devices for cleaning the filter elements within the system.

BACKGROUND OF THE INVENTION

Upright vacuum cleaners are well known in the art. Typically, these upright vacuum cleaners include a vacuum cleaner housing pivotally mounted to a vacuum cleaner foot. The foot is formed with a nozzle opening and may include an agitator mounted therein for loosening dirt and debris from a floor surface. A motor may be mounted to either the foot or the housing for producing suction at the nozzle opening. The suction at the nozzle opening picks up the loosened dirt and debris and produces a stream of dirt-laden air which is ducted to the vacuum cleaner housing.

In conventional vacuum cleaners, the dirt laden air is ducted into a vacuum cleaner filter bag supported on or within the vacuum cleaner housing. However, bagless vacuum cleaners have recently become prevalent in the marketplace. These bagless vacuum cleaners duct the stream of dirt-laden air into a dirt cup having a dirt collecting system which filters the dirt particles from the air stream before exhausting the filtered air stream into the atmosphere. Various dirt collecting systems have been used on these bagless vacuum cleaners to separate the dirt particles from the air stream. One drawback of cleaners having a single chamber with a filter element mounted therein is that the filter element is subjected to both the large particles and the small particles causing the filter element to clog. A new and improved dirt collecting system for a bagless vacuum cleaner which is capable of separating both large particles and small particles from a stream of air, and which separates the large particles from the air stream by a pre-filter before the air stream is filtered by a fine particle filter was disclosed in U.S. patent application Ser. No. 09/519,106, now abandoned, owned by a common assignee which is incorporated by reference fully herein. However, the need still exists to routinely clean both the pre-filter and fine particle filter. The present invention provides a cleaning member for both the pre-filter and the fine particle filter for a dirt collecting system similar to the dirt collecting system disclosed in U.S. patent application Ser. No. 09/519,106, now abandoned, owned by a common assignee.

There exists in the art patents for filter elements for cleaning appliances having a cleaning device for cleaning the filter element. For example, U.S. Pat. No. 5,143,529 issued to Means, Jr. discloses a filter cleaning apparatus for cleaning cylindrical filters. U.S. Pat. No. 3,797,064 issued to MacFarland discloses a hardbox upright vacuum cleaner having a filter bag cleaning brush within the box which is operable by a handle projecting from the box. In U.S. Pat. No. 1,038,167 issued to Maitland shows a vacuum cleaner filter basket that is brushed clean by a rotating filter element. U.S. Pat. No. 1,134,294 issued to Supanz provides a vacuum cleaner having a sieve for collecting dust, a rotating brush for sweeping the sieve, and a vane for rotating the brush. U.S. Pat. No. 3,591,888 issued to Takeda discloses an electrically operated vacuum cleaner having automatic filter-cleaning means. U.S. Pat. No. 3,841,067 issued to Kato et al. has an electric cleaner which includes a filter drum and a dusting unit disposed within the drum.

Objectives of the invention include providing a new and improved dirt collecting system for use in a bagless vacuum cleaner.

A further objective is to provide a new and improved dirt collecting system which provides a filter cleaning member for the pre-filter.

A still further objective is to provide a new and improved dirt collecting system which provides a filter cleaning member for the fine particle filter.

These and other objectives will be readily apparent from the following description taken in conjunction with the accompanying drawings.

SUMMARY OF THE INVENTION

In carrying out the invention in aspect thereof, these objectives and advantages are obtained by providing a dirt collecting system, including a dirt cup consisting of a coarse particle separation chamber, a fine particle separation chamber laterally disposed relative to the coarse particle separation chamber, and an apertured wall extending between the coarse particle separation chamber and the fine particle separation chambers, said apertured wall being formed with an aperture which provides fluid communication between said coarse particle separation chamber and said fine particle separation chamber. A lid is provided for sealing the dirt cup. A pre-filter is suspended in the aperture for preventing large particles from entering the fine particle separation chamber. The wall is slidably inserted between the coarse particle separation chamber and the fine particle separation chamber. A pre-filter cleaning member is suspended from opposing sides of the coarse particle separation chamber and is in operative engagement with the top edge of the pre-filter when the apertured wall is inserted between the coarse particle collecting chamber and the fine particle collecting chamber. The pre-filter cleaning member is cleaned by the brushing of the pre-filter cleaning member against the pre-filter as the apertured wall is slidingly removed from within the dirt cup.

In another aspect of the invention, a fine particle separation filter is rotatably mounted within the fine particle separation chamber for preventing small particles from exiting the fine particle separation chamber. A fine particle filter cleaning member is mounted on the wall in the fine particle separation chamber adjacent to the fine particle filter. The fine particle filter cleaning member is in contact with the outer periphery of the fine particle filter so that as the fine particle filter is rotated the fine particle filter cleaning member causes the edges of the fine particle filter to vibrate to knock loose particulate matter that may have accumulated thereon.

BRIEF DESCRIPTION OF DRAWINGS

Embodiments of the invention, illustrative of several modes in which applicants have contemplated applying the principles are set forth by way of example in the following description and are shown in the drawings and are particularly and distinctly pointed out and set forth in the appended claims.

DESCRIPTION OF THE PREFERRED EMBODIMENT

Figure 1:
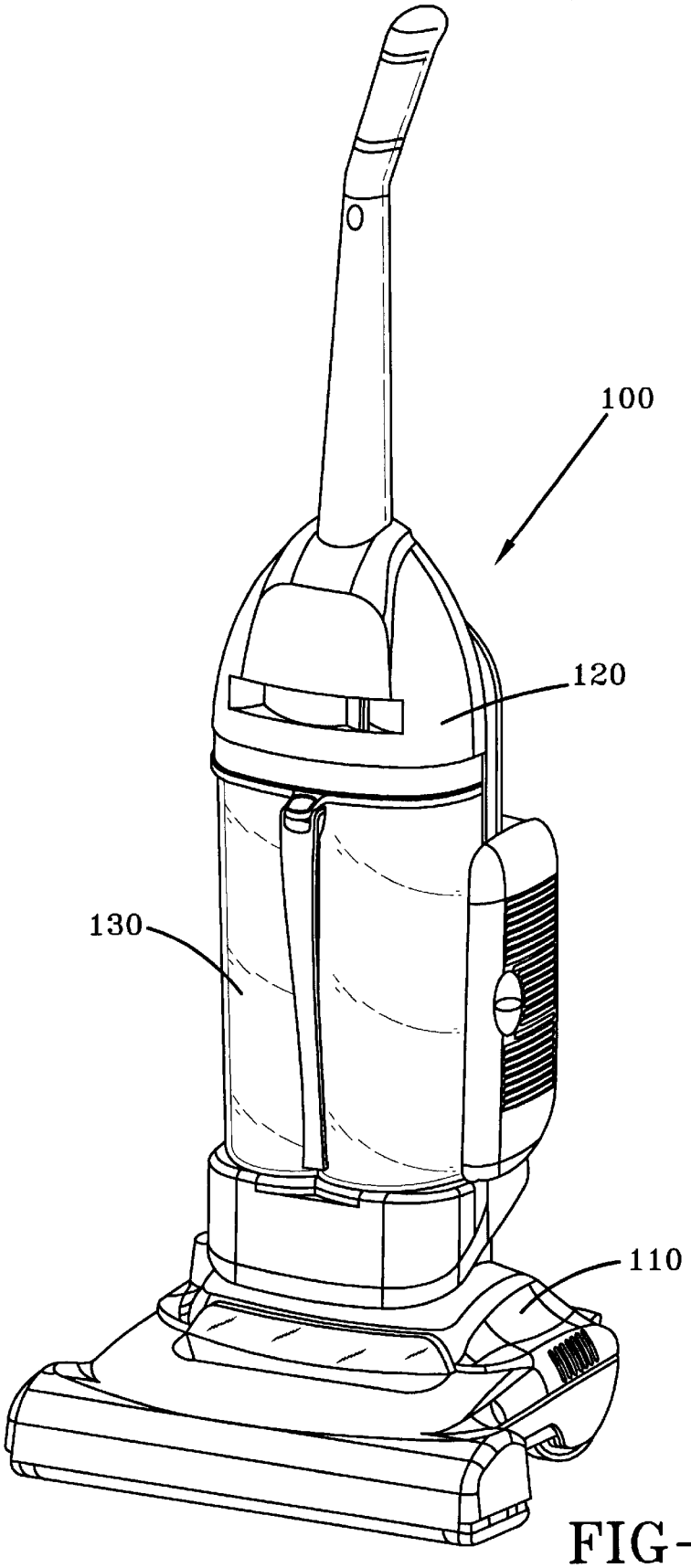
FIG. 1 is a left perspective view of a vacuum cleaner which includes the present dirt collecting system.

A vacuum cleaner incorporating the present dirt collecting system is shown in FIG. 1 and is indicated generally at 100. Vacuum cleaner 100 includes a vacuum cleaner foot 110 and a vacuum cleaner housing 120 connected to the vacuum cleaner foot 110. The foot 110 is formed with a bottom nozzle opening (not shown) which opens towards a floor surface. The vacuum cleaner 100 is of the type having an agitator (not shown) positioned within an agitator chamber (not shown) in foot 110 which communicates with the nozzle opening. The agitator rotates about a horizontal axis for loosening dirt from the floor surface. The present dirt collecting system 130 is removably inserted into the housing 120 of vacuum cleaner 100. The design of the cleaner is generally similar to the cleaner disclosed in U.S. patent application Ser. No. 09/519,106, now abandoned, owned by a common assignee and described previously.

Referring now to FIGS. 2 through 6, a motor-fan assembly 116 is fluidly connected to the dirt collecting system 130 via a motor housing cavity inlet opening 115 located in the top of motor housing 113 located on the lower portion of housing 120 and a clean air outlet opening 135 in the bottom of dirt cup 131. A hermetic seal between clean air outlet opening 135 and motor housing cavity inlet opening 115 is created when dirt cup 131 is inserted into cavity 125 of housing 120. Dirt cup 131 maybe held releasably within cavity 125 by a latch 121 or other means. Dirt cup 131 is fluidly connected to the agitator chamber (not shown) by a dirt duct 127. Dirt duct 127 is fluidly connected to dirt cup 131 by a dirt duct connector 126 and a dirty air inlet opening 136 (FIG. 6) in the rear wall 137 (FIG. 6) of dirt cup 131. Motor-fan assembly 116 has a suction inlet opening 117 which creates a suction in a motor housing cavity 118 located adjacent to motor-fan assembly 116. The suction created by motor-fan assembly 116 creates an airstream which draws in dirt-laden air from the agitator chamber (not shown) into dirt cup 131 through dirt duct 127 and dirty air inlet opening 136. The dirt laden airstream is then filtered in dirt cup 131 and the filtered airstream exits dirt cup 131 through clean air outlet opening 135. The airstream enters motor housing cavity 118 through motor housing cavity inlet opening 115. The airstream is moving in a generally vertical direction (represented by arrow 98) as it enters motor housing cavity 118 but must turn in a generally horizontal direction (represented by arrow 99) as it enters the suction inlet opening 117 of motor-fan assembly 116. Motor-fan assembly 116 has a generally horizontal orientation within motor housing 113.

In the preferred embodiment of the present invention, the coarse dirt particles are filtered by a coarse particle separation filter or pre-filter 151 (described further hereinbelow) which divides dirt cup 131 into a first chamber or coarse particle separation chamber 132 and a second chamber or fine particle separation chamber 133. A fine particle filter 160 is located in the fine particle separation chamber 133 for preventing fine dirt particles from exiting the fine particle separation chamber 133. Fine particle filter 160 is a cylindrical filter having an elongated longitudinal axis and a plurality of pleated edges 162 running the length of the longitudinal axis. The fine particle filter 160 is rotatably mounted on a coarse particle separation or pre-filter frame 150. An apertured wall or pre-filter frame 150 forms a frame around an aperture 151 which fluidly connects coarse particle separation chamber 132 with fine particle separation chamber 133. A pre-filter 152 is fitted in aperture 151 for preventing large particles from entering fine particle separation chamber 133 from coarse particle separation chamber 132. Pre-filter 152 may be any mesh type material or screening or other filtering media. However, it is understood that the pre-filter 152 may be formed of a number of different materials such as metal or synthetic mesh or screens, cloth, foam, a high-density polyethylene material, apertured molded plastic or metal, or any other woven, non-woven, natural or synthetic coarse filtration materials without affecting the concept of the invention.

The fine particle filter 160 is held in place adjacent to aperture 151 on pre-filter frame 150 by a circular post 163 on the top end cap 161 of fine particle filter 160 camming between a pair of fingers 155 and 156 extending sidewardly from the top end of pre-filter frame 150. The cut-out area 158 allows the fingers 155 and 156 to deflect outwardly permitting the circular post 163 to be inserted within the opening 157 between fingers 155 and 156. The stepped shoulder 165 of the open bottom end of fine particle filter 160 rests on the top surface of the bottom support member 153 by being inserted into an aperture 154 formed therein. In its assembled positioned, the fine particle filter 160 is supported vertically within the fine particle separating chamber 133 by bottom support member 153 and fingers 155 and 156 but is capable of rotation within aperture 154 and fingers 155 and 156. An annular seal 166 on the bottom of stepped shoulder 165 seals stepped shoulder 165 against aperture 135 and the bottom wall 134 of dirt cup 131 so that a suction is created by the suction motor 116 in fine particle chamber 133 through fine particle filter 160.

Figure 4:
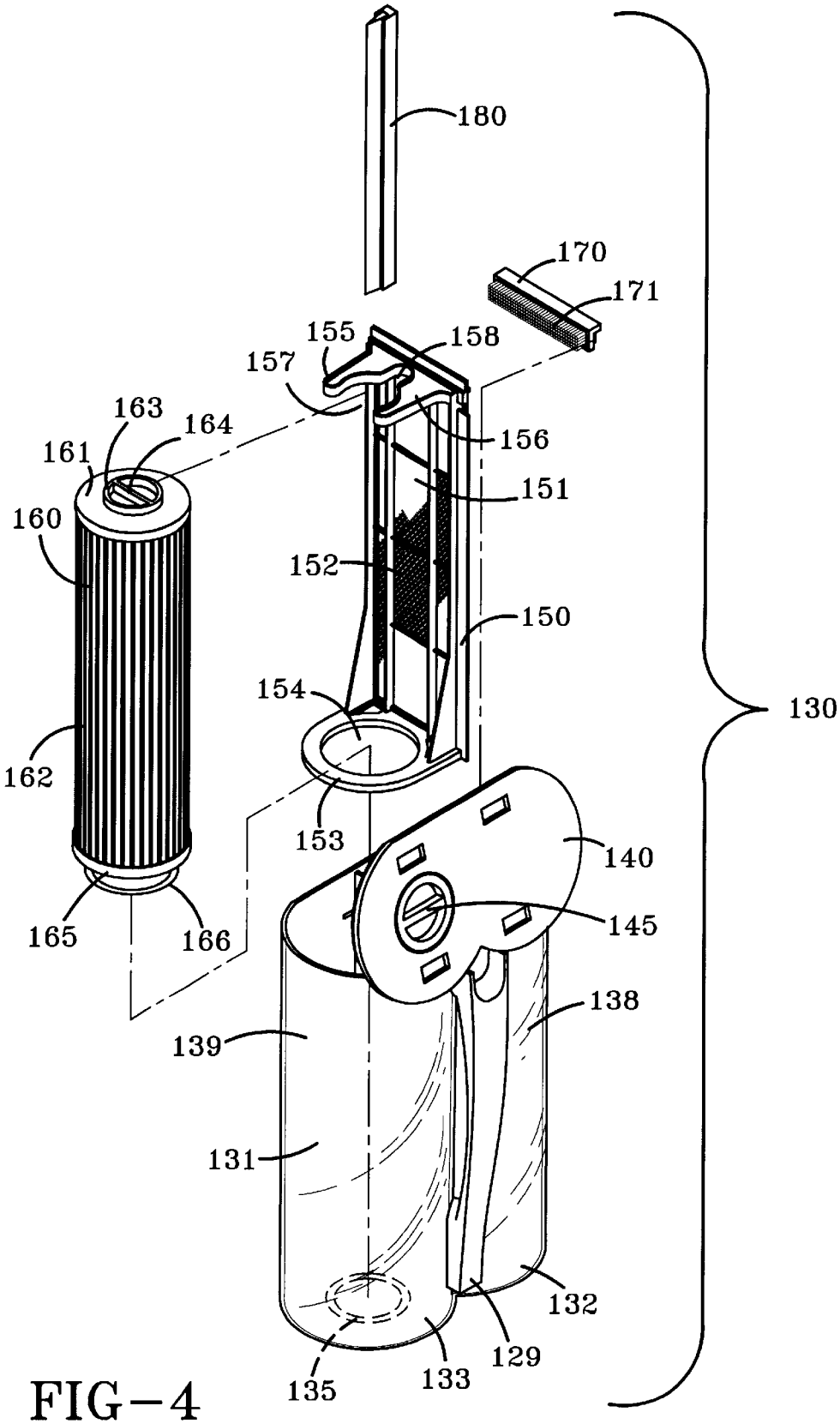
FIG. 4 is an exploded view of the dirt collecting system of the vacuum cleaner of FIG. 1.
Figure 5:
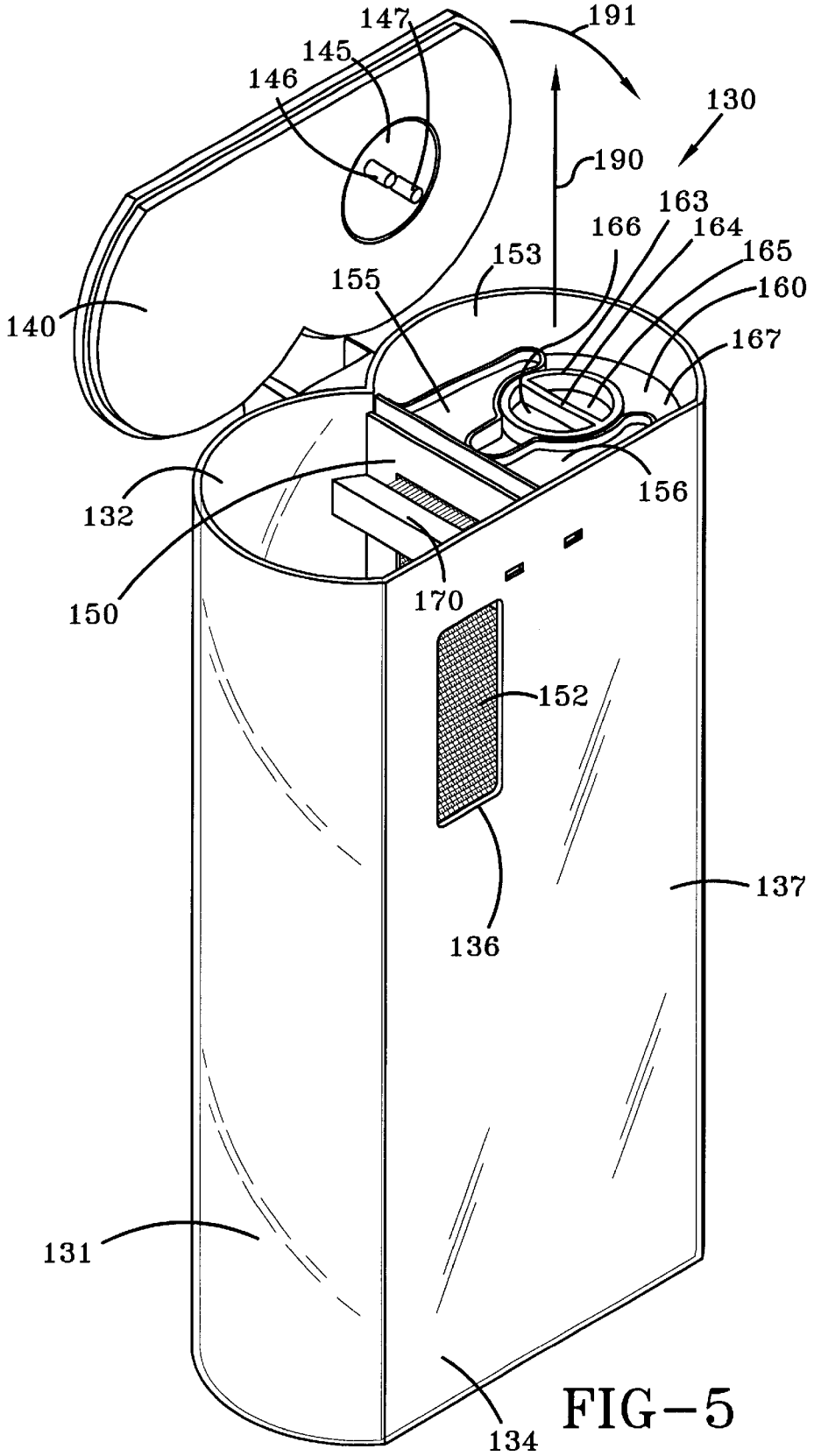
FIG. 5 is a rear perspective view of the dirt cup for the dirt collecting system of FIG. 4 showing the detail of the projections protruding from a lower surface of the rotating knob for engagement with the post on the top end of the fine particle filter.

Dirt cup 131 includes the bottom wall 134, a generally flat rear wall 137, a pair of curved side walls 138 and 139, and a handle 134. Rear wall 137 and side walls 138 and 139 extend upwardly from the bottom wall 134 to form a single chamber. The single chamber is divided into two separate chambers, a coarse particle separation chamber 132 and a fine particle separation chamber 133 when pre-filter frame 150 and pre-filter 152 are inserted therein as shown in FIG. 5. Grooves or channels (not shown) may be formed on the inner surface of sidewalls 137, 138 and 139 to slidably receive the edges of pre-filter frame 150 to hold it in place or other means could be used. The curved sidewalls 138 and 139 curve inwardly and meet at a front center indentation. The pre-filter frame and pre-filter are inserted into dirt cup 131 at the indentation to form the two dirt separation chambers. A handle 150 is provided on the front of the dirt cup 131 to allow easy handling of the dirt cup 131. A lid 140 is also provided for sealing dirt cup 131 and dirt collecting system 130 when in the installed position in cleaner 100. Lid 140 is shown in the closed or sealing position in FIG. 3 and in the open position in FIG. 4. Lid 140 has a rotating member or knob 145 inserted therethrough for rotating fine particle filter 160 as described further hereinbelow.

Figure 2:
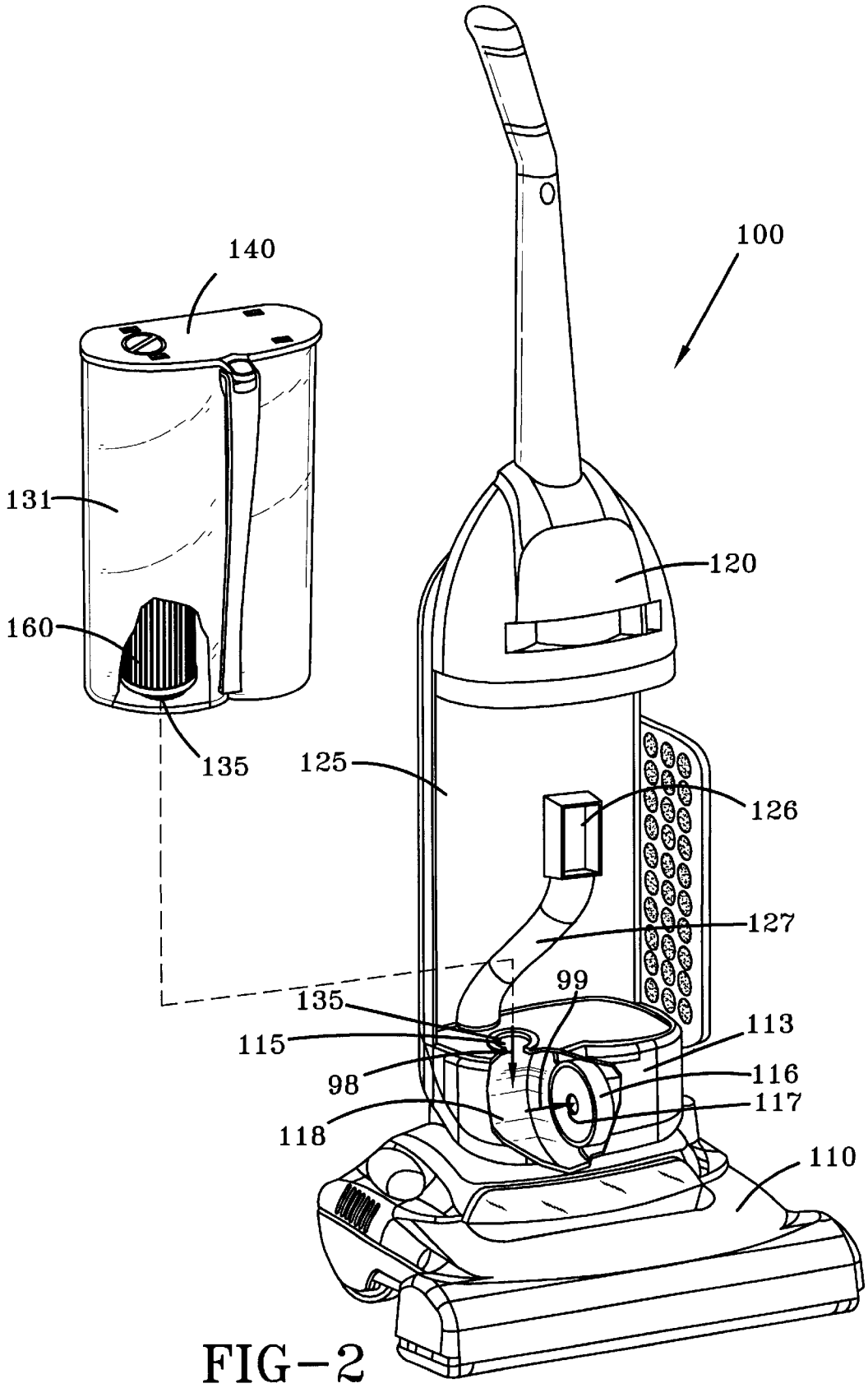
FIG. 2 is a right perspective view of the vacuum cleaner of FIG. 1 with the dirt cup removed from the cleaner housing; and a partial cutaway view of the dirt cup showing the fine particle separation filter located therein.
Figure 3:
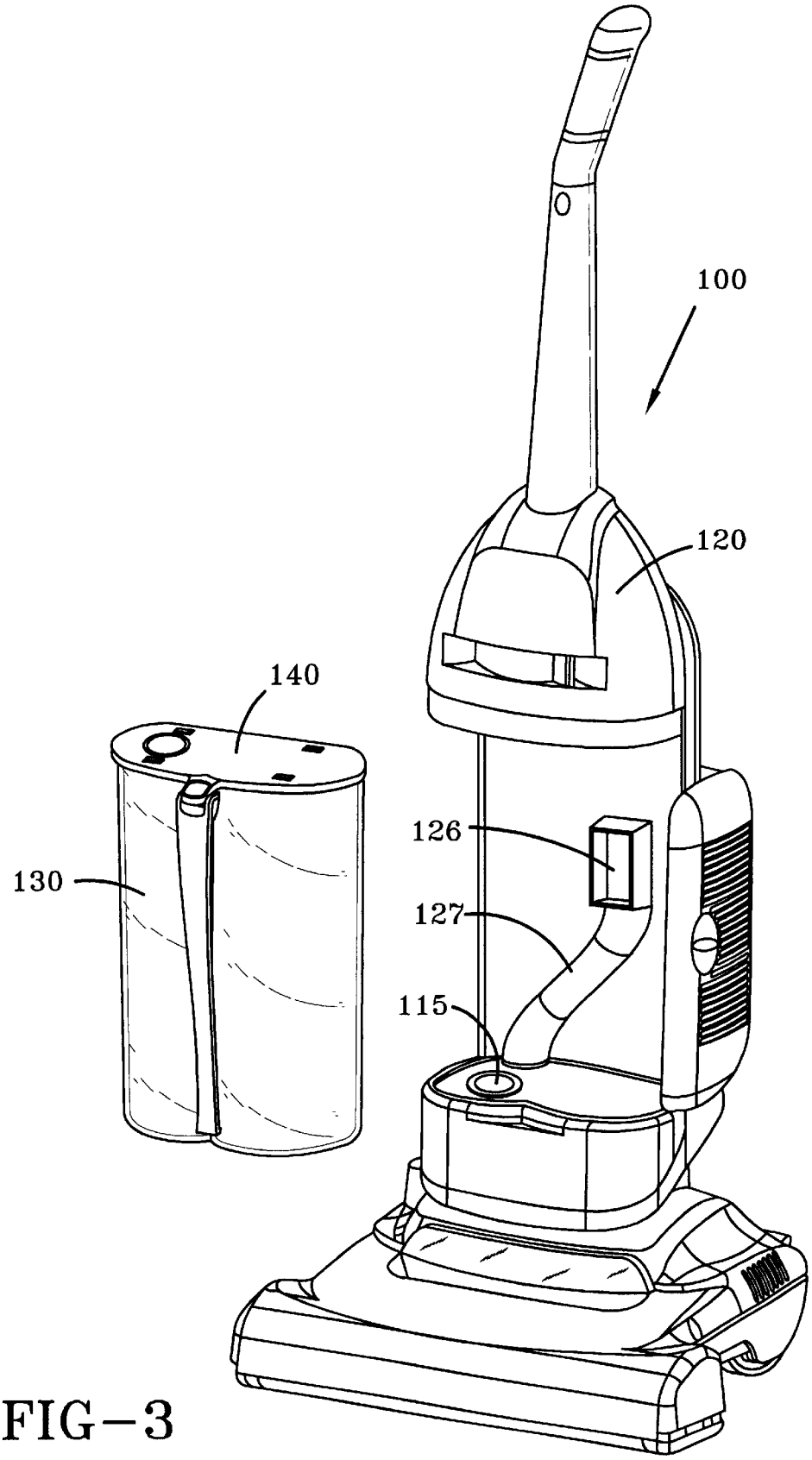
FIG. 3 is a left perspective view of the vacuum cleaner of FIG. 1 with the dirt cup removed from the cleaner housing.
Figure 7:
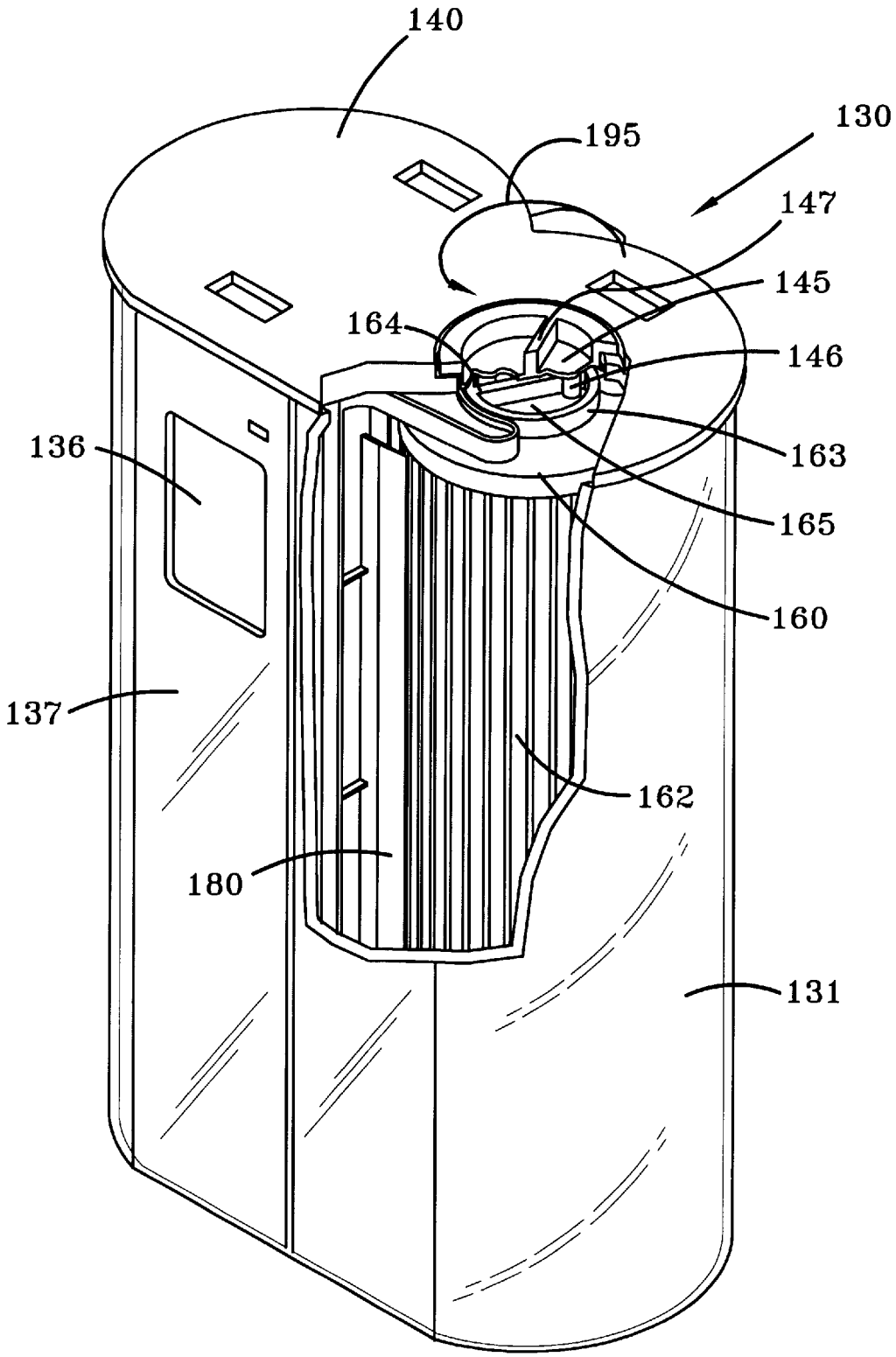
FIG. 7 is a rear perspective view of the dirt cup for the dirt collecting system of FIG. 4 with a partially cutaway portion showing the detail of the fine particle filter cleaning member positioned adjacent to the fine particle filter.

Referring now specifically to FIG. 5, shown is pre-filter frame 150 in the installed position inside dirt cup 131 and dividing the single chamber of dirt cup 131 into coarse particle chamber 132 and fine particle chamber 133. Pre-filter frame 150 supports fine particle filter 160 in the vertical position and also supports pre-filter 152 between coarse particle chamber 132 and fine particle chamber 133. The suction created by the motor-fan assembly 116 (FIG. 2) in fine particle chamber 133 draws the dirt laden airstream into fine particle chamber 133 but large particles are prevented from entering by pre-filter 152. Fine particle filter 160 prevents fine particles from exiting fine particle chamber 133 and entering the motor housing cavity inlet opening 115 (FIG. 2). Also shown is the circular post 163 on the top end cap 161 of fine particle filter 160 camming between the pair of fingers 155 and 156. Circular post 163 has transverse gripping member 164 located on its inner periphery with a pair of cavities 165 and 166 located on opposing sides of gripping member 164. Cavities 165 and 166 each receive one of a pair of projections 146 and 147 on the lower surface of rotating member 145 in lid 140 as lid 140 is rotated in the direction of arrow 191 into the closed or sealing position as illustrated in FIG. 7. The engagement of projections 146 and 147 with cavities 165 and 166 be discussed more fully hereinbelow. A pre-filter cleaning member 170 or brush is installed at the top of dirt cup 131 on pre-filter frame 150 on the coarse particle separation chamber 132 side of pre-filter frame 150. Pre-filter cleaning member 170 is suspended between rear wall 137 and sidewall 138. Pre-filter cleaning member 170 may be installed using tabs, adhesives, or other means without affecting the concept of the invention. The pre-filter cleaning member 170 has a plurality of sidewardly extending projections or bristles 171 that are positioned adjacent to pre-filter 152 which are also in operative engagement with pre-filter 152. When pre-filter frame 150 is in the fully inserted position inside dirt cup 131 as shown in FIG. 4, bristles 170 are in operative engagement with the top of pre-filter 152.

Figure 6:
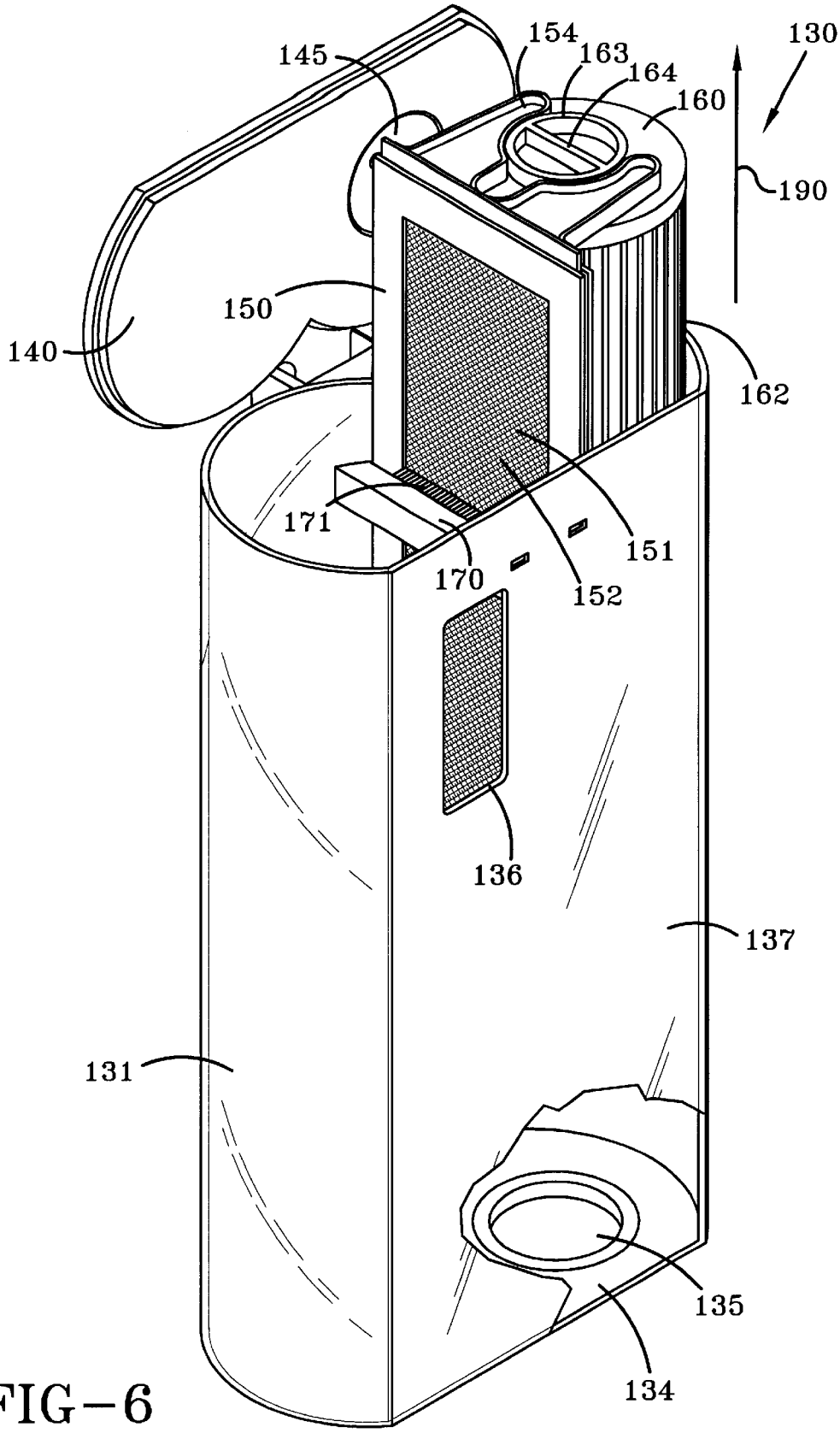
FIG. 6 is a rear perspective view of the dirt cup for the dirt collecting system of FIG. 4 showing the detail of the removal of the pre-filter and fine particle filter from the dirt cup and the clean air outlet at the bottom of the dirt cup.

Referring now specifically to FIG. 6, whenever it is desired to remove pre-filter frame 150 from dirt cup 131, such as when it is desired to clean pre-filter 152 or empty dirt cup 131, pre-filter frame 150 is pulled in the direction of arrow 190, and the bristles 171 of pre-filter cleaning member 170 engage or brush pre-filter 152 thereby removing any dirt particles that may have accumulated thereon. The brushing of pre-filter 152 continues along the entire length of pre-filter 152 as long as pre-filter frame 150 is moved in the direction of 190. Eventually, if pre-filter frame 150 is moved enough distance in the direction of arrow 190, pre-filter frame 150, pre-filter 152 and fine particle filter 160 will be completely removed from dirt cup 131. Any accumulated contents in dirt cup 131 may be emptied at this time. To resume normal use, pre-filter frame 150 with pre-filter 152 and fine particle filter 160 located thereon is simply reinserted into dirt cup 131.

Referring now finally to FIG. 7, a fine particle filter cleaning member 180 (also shown in FIG. 3) is provided for removing accumulated particles from fine particle filter 160. Fine particle filter cleaning member 180 is installed on pre-filter frame 150 adjacent to fine particle filter 160 such that an elongated edge of fine particle filter cleaning member 180 is in operative engagement with one of the pleated edges 162 on the outer periphery of fine particle filter 160. Fine particle filter cleaning member 180 is a brush or wiper blade made from a flexible material such as plastic or rubber and is mounted to pre-filter frame 150 with clips or other fastening members. Fine particle filter cleaning member 180 can also be made from metal or solid flexible member or series of smaller flexible members. Whatever material or fastening members used with fine particle filter cleaning member 180 does not affect the concept of the invention. When it is desired to clean fine particle filter 160, such as every time dirt cup 131 is emptied or when clogged, fine particle filter 160 may be rotated past fine particle filter cleaning member 180 by gripping rotating member or knob 145 in lid 140 and turning in the direction of arrow 195. The projections 146 and 147 on the lower surface of rotating member 145, which were received by cavities 165 and 166, engage gripping member 164 thereby causing fine particle filter 160 to rotate. Of course lid 140 must be in the closed position. As fine particle filter 160 rotates, fine particle filter cleaning member 180 engages or strikes in succession each of pleat of the plurality of pleats 162 of fine particle filter 160 causing the pleat 162 to vibrate and shake loose accumulated particles. This process is repeated as each of the plurality of pleats 162 is rotated past fine particle filter cleaning member 180. Fine particle filter 160 may be cleaned in this manner as often as necessary.

Accordingly, the improved dirt collecting system for a vacuum cleaner is simplified, provides an effective, inexpensive, and efficient device which achieves all of the enumerated objectives. While there has been shown and described herein a single embodiment of the present invention, it should be readily apparent to persons skilled in the art that numerous modifications may be made therein without departing from the true spirit and scope of the invention. Accordingly, it is intended by the appended claims to cover all modifications which come within the spirit and scope of the invention.

What is claimed is:

1. An improved dirt collecting system for a vacuum cleaner, the vacuum cleaner having a motor-fan assembly with a suction inlet opening, a dirt collecting chamber, and a housing, the motor-fan assembly creating a dirt laden airstream throughout the vacuum cleaner, the improvement comprising the dirt collecting chamber comprising:

a fine particle separation chamber;

a coarse particle separation chamber;

a coarse particle separation filter slidably mounted into and extending across said dirt collecting chamber and further dividing said dirt collecting chamber into the coarse particle separation chamber and the fine particle separation chamber;

a dirty air inlet opening formed in said dirt collecting chamber;

a clean air outlet opening formed in said dirt collecting chamber;

a fine particle separation filter rotatably mounted in said fine particle separation chamber upstream of said clean air outlet, whereby all the air exiting said clean air outlet must pass through said fine particle separation filter;

a fine particle separation filter cleaning device mounted adjacent to said fine particle separation filter and in operative engagement with said fine particle separation filter, said fine particle separation filter cleaning device vibrating said fine particle separation filter to knock loose accumulated particles when said fine particle separation filter is rotated; and a lid for sealing said dirt collecting chamber;

a coarse particle separation filter cleaning device mounted in said dirt collecting chamber in operative engagement with said coarse particle separation filter, said coarse particle separation filter cleaning device cleaning said coarse particle separation filter when said coarse particle separation filter is slidably removed from within said dirt collecting chamber.

2. The improved dirt collecting system for a vacuum cleaner of claim 1, further including a rotating member mounted in said lid in operative engagement with said fine particle separation filter to rotate said fine particle separation filter.

3. The improved dirt collecting system for a vacuum cleaner of claim 2, wherein said rotating member is a knob.

4. The improved dirt collecting system for a vacuum cleaner of claim 2, wherein said fine particle separation filter has a top end cap and a circular post located thereon, said circular post further including a transverse gripping member located on an inner periphery and a pair of cavities located on opposing sides of the gripping member.

5. The improved dirt collecting system for a vacuum cleaner of claim 4, wherein said rotating member has a pair of projections on a lower surface of the rotating member for engaging said pair of cavities on the circular post of the fine particle separation filter.

6. The improved dirt collecting system for a vacuum cleaner of claim 1, wherein said coarse particle separation filter is mounted on a coarse particle separation filter frame.

7. The improved dirt collecting system for a vacuum cleaner of claim 6, wherein said coarse particle separation filter frame is slidably mounted in said dirt collecting chamber.

8. An improved dirt collecting system for a vacuum cleaner, the vacuum cleaner having a motor-fan assembly with a suction inlet opening, a dirt collecting chamber, and a housing, the motor fan assembly creating a dirt laden airstream throughout the vacuum cleaner, the improvement comprising a dirt collecting chamber comprising:

a first particle separation chamber;

a second particle separation chamber;

a coarse particle separation filter is slidably mounted into and extending across said dirt collecting chamber and further dividing said dirt collecting chamber into the first particle separation chamber and the second particle separation chamber;

a dirty air inlet opening formed in said dirt collecting chamber;

a clean air outlet opening formed in said dirt collecting chamber;

a lid for sealing said dirt collecting chamber;

a coarse particle separation filter cleaning member mounted in said dirt collecting chamber in operative engagement with said coarse particle separation filter, said coarse particle separation filter cleaning member cleaning said coarse particle separation filter when said coarse particle separation filter is slidably removed from within said dirt collecting chamber.

9. The improved dirt collecting system for a vacuum cleaner of claim 8, wherein said coarse particle separation filter is mounted on a coarse particle separation filter frame.

10. The improved dirt collecting system for a vacuum cleaner of claim 9, wherein said coarse particle separation filter frame is slidably mounted in said dirt collecting chamber.

11. An improved dirt collecting system for a vacuum cleaner, the vacuum cleaner having a motor-fan assembly with a suction inlet opening, a dirt collecting chamber, and a housing, the motor-fan assembly creating a dirt laden airstream throughout the vacuum cleaner, the improvement comprising a dirt collecting chamber comprising:

a first particle separation chamber;

a second particle separation chamber;

a dirty air inlet opening formed in said dirt collecting chamber;

a clean air outlet opening formed in said dirt collecting chamber;

a fine particle separation filter rotatably mounted in said first particle separation chamber upstream of said clean air outlet, whereby all the air exiting said clean air outlet must pass through said fine particle separation filter;

a fine particle separation filter cleaning device mounted adjacent to said fine particle separation filter and in operative engagement with said fine particle separation filter, said fine particle separation filter cleaning device vibrating said fine particle separation filter to knock loose accumulated particles when said fine particle separation filter is rotated; and a lid for sealing said dirt collecting chamber.

12. The improved dirt collecting system for a vacuum cleaner of claim 11, further including a rotating member mounted in said lid in operative engagement with said fine particle separation filter to rotate said fine particle separation filter.

13. The improved dirt collecting system for a vacuum cleaner of claim 12, wherein said rotating member is a knob.

14. The improved dirt collecting system for a vacuum cleaner of claim 12, wherein said fine particle separation filter has a top end cap and a circular post located thereon, said circular post further including a transverse gripping member located on an inner periphery and a pair of cavities located on opposing sides of the gripping member.

15. The improved dirt collecting system for a vacuum cleaner of claim 14, wherein said rotating member has a pair of projections on a lower surface of the rotating member for engaging said pair of cavities on the circular post of the fine particle separation filter.

* * * * *